United States Patent [19]

Gerlach et al.

[11] Patent Number: 4,598,463

[45] Date of Patent: Jul. 8, 1986

[54] PROCESS FOR PRODUCTION OF COMMUTATOR

[75] Inventors: Karl-Heinz Gerlach, Ehningen; Lothar Wörner, Stuttgart, both of Fed. Rep. of Germany

[73] Assignee: Kautt & Bux KG, Fed. Rep. of Germany

[21] Appl. No.: 665,088

[22] Filed: Oct. 26, 1984

Related U.S. Application Data

[62] Division of Ser. No. 556,095, Nov. 29, 1983, abandoned.

[30] Foreign Application Priority Data

Dec. 10, 1983 [DE] Fed. Rep. of Germany ..... 3245699

[51] Int. Cl.[4] ..... H01R 43/06

[52] U.S. Cl. ..... 29/597; 310/42; 310/43; 310/46

[58] Field of Search ..... 29/597, 446; 310/42, 310/43, 46

[56] References Cited

U.S. PATENT DOCUMENTS

| | | | |
|---|---|---|---|
| 2,477,455 | 7/1949 | Hinchliff | 310/236 |
| 2,674,784 | 4/1954 | Roberts et al. | 310/235 X |
| 3,450,914 | 6/1969 | Demerciere | 310/236 |
| 3,899,705 | 8/1975 | Heil | 310/236 X |
| 4,056,882 | 11/1977 | Letts | 29/597 |

FOREIGN PATENT DOCUMENTS 3048470 11/1980 Fed. Rep. of Germany .

*Primary Examiner*—Howard N. Goldberg
*Assistant Examiner*—Leonard S. Selman
*Attorney, Agent, or Firm*—Wigman & Cohen

[57] ABSTRACT

A commutator of the arch-thrust type and process for its production, wherein at least one annular slot is provided in its segment set which is located concentrically to the longitudinal axis of the commutator and into which an armoring ring is placed which is under tension. In order to be able to produce the commutator in a cost-effective manner in spite of a high dynamic and thermal load capability, the segments are provided with punches forming the annular slots. The boundary surface of the annular slot which serves as a support of the armoring ring defines a polygon and is maintaining the insulation using molded plastic or air between the segments which are separated by insulation material radial outwardly of the annular slot. In the production, the segment set is temporarily reduced in its diameter at least to the extent that, subsequently, the armoring ring can be made to slide into the annular slot formed by a punch in the segments, closed partly towards the central longitudinal axis and forming a seat for the armoring ring.

15 Claims, 12 Drawing Figures

1
2
3
4
5
6
7
7'
7''

PROCESS FOR PRODUCTION OF COMMUTATOR

This application is a division of application Ser. No. 556,095, filed Nov. 29, 1983, now abandoned.

BACKGROUND OF THE INVENTION

The invention concerns a commutator of the arch-thrust type, as well as a process for the production of such a commutator.

The armoring rings of commutators of the arch-thrust type have the task of maintaining the segment set, not only in an inoperative state, but also under the thermal and dynamic load occurring during operation, under so high an arch-thrust that the individual segments cannot shift relative to each other. Shrunk rings are frequently used with such commutators as armoring rings. Customarily, these shrunk rings are placed into annular slots which must be machined into the two front ends of the segment set after the latter has been assembled from individual segments and insulating plates, provided between every adjacent segments.

However, in order to be able to perform this operation, the assembled segment set must be first pressed into a thick-walled pressure sleeve so as to have the possibility of cutting the annular slot on the turning machine into the two front ends of the segment set which is now under arch-thrust. Subsequently, the heated shrunk rings can be placed into and shrunk on the grooves at the front ends and the armored segment set, and then the set is ejected from the pressure sleeve. This production method is relatively complex and expensive, particularly since a correspondingly high tool requirement is given in the form of a great number of thick-walled pressure sleeves for a rational production of a higher number of sets and commutators.

Furthermore, the annular slots necessary to receive the shrunk rings can only be cut when the insulating plates extend into the area of the cut and, therefore, the insulating plates have, as a rule, the same shape as the copper segments. An additional disadvantage of the known commutators with shrunk rings placed in annular slots lies in the fact that the shrunk rings can only be provided at the ends of the segment set. Therefore, a high dynamic load of the commutator or a greater axial length requires not only larger dimensions for the shrunk rings but also an increase in the radial dimensions of the segments and, therefore, in the outer diameter of the commutator in order to prevent by a higher bending resistance of the segments that they can be deformed radially towards the outside or can move relative to each other in the area between the shrunk rings under the effective centrifugal force owing to too low an arch-thrust. Matters get even more complicated owing to the fact that, because the radial dimensions of the segments must be chosen of a larger size, the centrifugal force affecting them is again increased. Since such an increase in the radial height of the segments is not necessary for electrical reasons, expensive copper is used for purely mechanical reasons. Therefore, such commutators are relatively expensive so that their area of application is limited to qualitatively demanding and highly loaded electrical machines.

Two other known designs of commutators of the arch-thrust type are also rather complex even though there is no requirement of cutting annular slots into the segment set. In one design, the shrunk rings rest against the outer cover surface of the commutator with an insulation material between them and the commutator. For this reason, the commutator must be given a considerably larger axial length than would otherwise be required for electrical purposes. Additionally, the space requirement of the commutator is considerably increased by means of such shrunk rings located at the outside. In the other design, a commutator with compression molding material permits the use of armoring rings located inside, i.e. armoring rings which are located in annular L-slots extending from the inner cover surface of the segment set into the latter. Such annular L-slots in the inside are formed by punching out the segments as well as the insulating plates. The punches in the insulating plates are shaped in such a way that they keep the inserted armoring ring at a distance from the boundary surfaces of the annular L-slot formed by the segments, as is also the case for commutators with compression molding material which have armoring rings only in front-end grooves. The molding material must actually be able to penetrate into the annular L-slots in order to form there a jacket for the armoring ring. Thus, the armoring rings can only be placed into the annular L-slots without initial tension in the case of these known commutators with molding material. Tension is created by first the segment set being pressed into the mold and thus kept under arch thrust. It then expands after being filled with molding material when being ejected from the mold, necessarily its arch-thrust. The arch-thrust must be kept relatively low so that the expansion of the segment union caused by the arch-thrust does not lead to a destruction of the molded material after the ejection from the mold. Because of these reasons, the field of applications of these commutators is highly limited. Due to their relatively low arch-thrust, they are not suitable for a higher dynamically load.

A commutator is disclosed in the German Disclosure Publication 30 48 470 with a hub under initial radial tension where the segment set is provided with armoring rings being inserted under no tension as in the case of the above mentioned commutator and filled with compression molding material. This permits, therefore, only a relatively low initial tension of the hub, whereby a smooth behavior of the running surface for the brushes can also only be guaranteed under a rather low thermal and dynamic load.

SUMMARY AND OBJECTS OF THE INVENTION

An object of the invention is to create a commutator of the arch-thrust type which can be subjected to a high dynamic and thermal load, but whose production is, nevertheless, cost-effective. This is achieved by a commutator according to claim 1.

Because the segments are provided with punches in order to form the annular slot or slots, the complex cutting of annular slots into the segment set is avoided. One can then provide one or several annular T-slots or L-slots extending from the inner cover surface of the segment set into the inside thereof. Furthermore, the insulating plates need not be extended into the area of the annular slots. This decreases the production costs as well. Since the armoring ring rests directly on the polygonal boundary surface of the annular slot which is formed by the segments, a relatively high tension of the armoring rings can be achieved. This is due not only to the fact that the load capacity of molding material must not be taken into consideration, since this is also the case for the known commutators with compression molding material where this material fills the interspace between the armoring ring and the boundary surfaces of the annular slots. There is then actually the possibility of maintaining the segment set assembled from punched segments and the insulating plates under a high arch-thrust by the armoring rings already before being filled with molding material. One may even press or shrink not only the two outer armoring rings but also the armoring ring or rings, located inside, on their seats whereby these armoring rings receive already a high initial tension without an expansion of the segment set.

The size of the initial tension of the armoring rings as well as the size of the arch-thrust and the extent of the expansion of the segment set after the mounting of the armoring rings have no influence on the stress to which the molding material is subjected which may be inserted in the segment set because the molding material is only applied after the armoring rings have received their initial tension.

Thus, the solution according to the invention is advantageous in order to achieve as high an arch-thrust as possible as well as a high initial radial tension of the hub of the commutator and/or anchor shaft as it is provided for the commutator according to the German Disclosure Publication 30 48 470 in order to avoid a deformation by heat or, at least, reduce it to a low value.

Because the armoring rings can be arranged at relatively short distances over the length of the segments, the bending load of the segments can be considerably reduced. In this way, the height of the zone of the segment beyond the armoring rings can be restricted to an electrically and thermally required dimension. The cross-section and especially the height of the armoring rings as well as the height of the segment parts serving as their bearing surface can be kept relatively low as well so that a minimum segment height can be achieved which leads to a considerable saving of copper. A decrease in the production complexity is, furthermore, obtained by the fact that the punches serving to form the annular slots can be produced simultaneously with the cutting of the segments from a profiled bar.

The armoring rings may have a core consisting of steel and a jacket consisting of an electrically insulating material. However, the armoring rings may also consist of an electrically insulating, fiber-reinforced plastic material.

The high tension-capacity of armoring rings of a fiber-reinforced plastic material must be achieved by means of an increased expansion owing to their higher dilatibility in comparison with steel rings. Therefore, for such rings the seat of each ring formed by the segments has preferably a diameter which is tapered towards the opening of the annular slot so that the inclination relative to the central longitudinal axis is in the area of automatic locking. The armoring ring may then be pressed on its seat which, as a rule, is not possible with rings of steel having an insulation jacket because of the possibility of damage. A seat with an angle of inclination which is outside the area of self-locking leads actually to an even higher initial tension of the ring which is to be pressed on but it requires that elements, preferably barbs, be provided on the segments in the area of the seat, which prevent a movement of the armoring ring towards the opening.

The process of production of commutators according to this invention can be performed in a simple and cost-effective manner since, after the assembly of the segment set and the placing of the armoring rings into the opening of the assigned annular slot, only the diameter of the segment set need be reduced until each armoring ring can be slid on its seat. When the effect of the force on the segment set which serves the reduction of the diameter of the segment set is then terminated, the latter can be completed in the known manner to become a commutator with either as high an arch-thrust as possible or a commutator in which the initial tension of the hub and/or anchor shaft is based on an essential and predetermined part of tension of the armoring rings. In the last mentioned case all segments of the segment set are then force-fittingly coupled with the hub and/or anchor shaft during all operating conditions owing to the support forces of the hub and/or shaft and are positioned in a radial direction relative to the hub and/or shaft.

The reduction of the diameter of the segment set to a value permitting the armoring rings to slide on their seats is, preferably, effected with the help of a tapered bushing with which the segment set is pressed into a thick-walled cylindrical sleeve.

If an even higher initial tension of the armoring rings is desired than can be achieved when the armoring rings are made to slide on their seats with as little play as possible, the armoring rings can be inductively heated before being made to slide on their seats. The diameter which the armoring rings have in their cold state can then be chosen smaller by the amount of the thermally caused diameter enlargement. The entire initial tension of the armoring rings is then higher by that initial tension which the armoring rings reach when being shrunk on their seats after the effect of the force exerted on the segment set has been terminated for the purpose of the reduction in diameter. In order to prevent such an inductive heating, which is preferably effected with the help of a ring inductor of a medium frequency generator inserted into the borehole of the segment set, that the diameter of the bushing receiving the segment set changes during the operation, a bushing is preferably used of an anti-magnetic steel. In the case of a preferred design, this bushing is, furthermore, kept at a constant temperature using a water cooling system with the help of a thermal sensor.

If the armoring rings consist of a fiber-reinforced plastic material, it is expedient to press these armoring rings on their seats in the axial direction while achieving simultaneously the expansion in view of the fact that such armoring rings cannot be shrunk on, and request a higher expansion than a steel ring. In this way, a relatively high initial tension can be achieved even with such reinforced rings.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

The invention is explained in greater detail below with the help of exemplified embodiments shown in the drawing.

DETAILED DESCRIPTION OF A PREFERRED EMBODIMENT

Figures 1, 2, 3, 4:
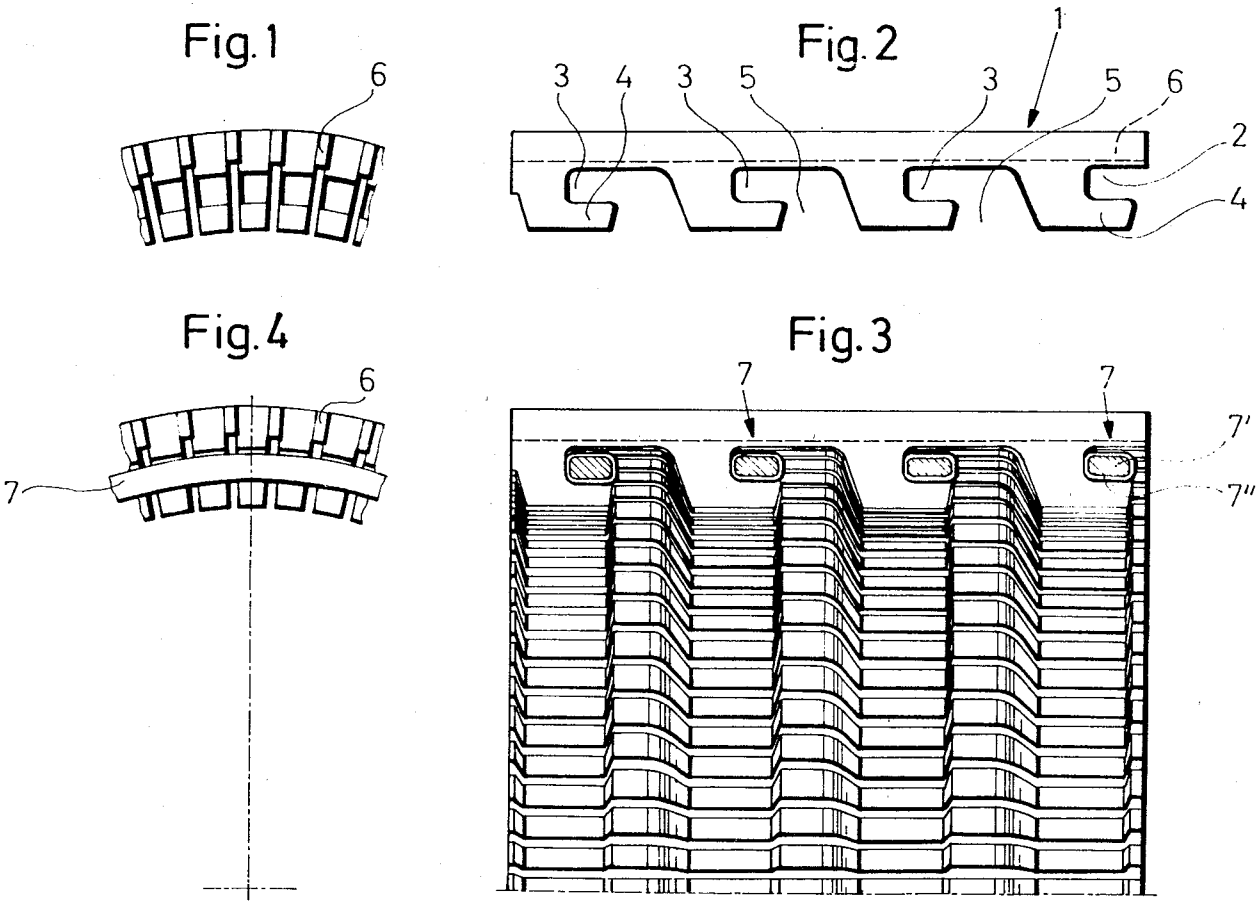
FIG. 1 is a partial front view of the loosely assembled segment set of the first exemplified embodiment.
FIG. 2 is a side view of a segment of the segment set according to FIG. 1.
FIG. 3 is a partial longitudinal cross-section of a segment set of the first exemplified embodiment kept under arch-thrust pressure by its armoring rings.
FIG. 4 is a partial front view of the segment set shown in FIG. 3 in accordance with FIG. 1.
Figure 6:
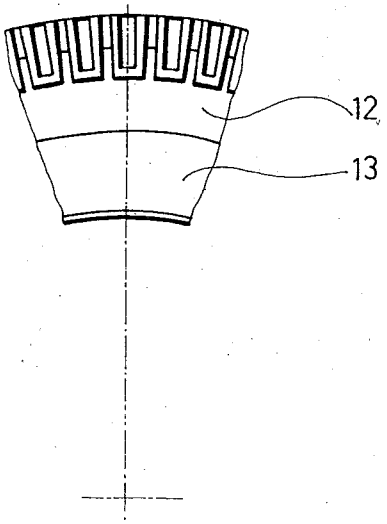
FIG. 6 is a partial front view of this commutator.

One proceeds with equally designed segments 1 as they are shown, for example, in FIG. 2 for the production of the first exemplified embodiment of the commutator according to the invention as shown in FIGS. 1 to 6. These segments 1 are cut off from a profiled bar of copper. When doing so, a recess 2 open towards one end and three equally shaped recesses 3 are simultaneously punched out. These recesses 2 and 3 are arranged across the length of the segment 1. Their distance from each other is relatively slight as is shown in FIGS. 2 to 5. Therefore, in spite of the high dynamic stress to which the commutator can be exposed, it is possible to keep very low the height of the segments 1 measured in the radial direction of the commutator and thus also the dimension between the recesses 2 and 3 as well as the outside cover surface of the commutator.

Figure 5:
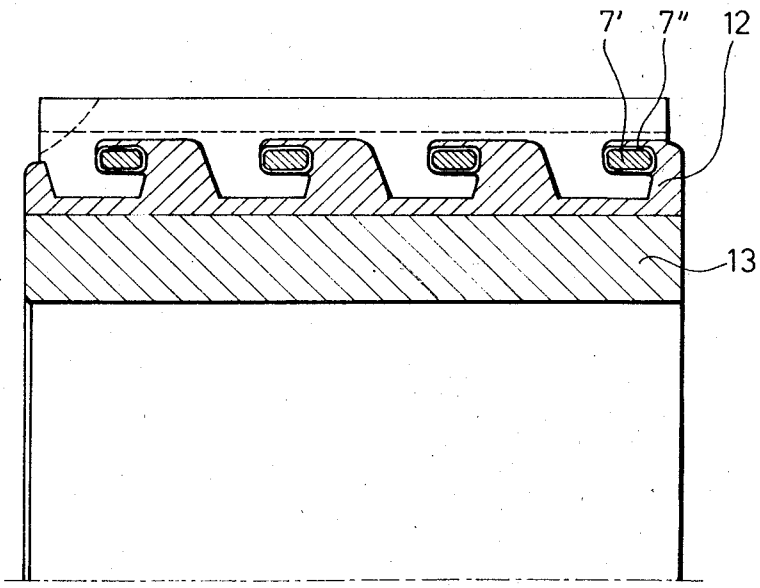
FIG. 5 is a partial longitudinal cross-section of the commutator produced of the segment set according to FIG. 3.

Each recess 3 which has an approximately rectangular cross-section, as has the recess 2 as well, is closed towards the central longitudinal axis of the commutator across a part of its length by means of a hook-like material portion 4. This material portion 4 is followed by one opening 5 each in the longitudinal direction of the commutator whose axial length is greater than that of the material portion 4. As is shown in FIGS. 2 and 5, the opening 5 is expanded towards the axis of the commutator in a wedge-shaped manner and one of the flanks of the opening 5 forms the extension of one of the front end boundaries of the recess 3.

Because of the shape of the recesses 3, which form each an annular L-slot an armoring ring 7 can be placed through each opening in each recess, after having assembled all segments 1 and after insulating plates 6 have been placed between each of two adjacent segments 1 to form a loose segment set. The insulating plates 6 have the shape of a rectangular strip. As is shown in FIGS. 1 to 6, it covers the entire length of the segments and, from the outer cover surface of the commutator radially towards the inside, almost to the recesses 2 and 3. Such a shape of the insulation material 6 contributes to the favorable production costs, also in view of the fact that insulation material of this shape can be applied on segments which have a different number of recesses as well as recesses of a different shape.

The armoring rings 7 have a core 7' of steel as well as an insulation 7'' surrounding this core. This insulation consists of a very thin strip which is wound around the core by having it overlap at the edges. It has not only a high insulting capacity but also a high pressure resistance. The dimensions of the recesses 2 and 3 are adjusted to the dimensions of the armoring rings 7 in such a fashion that the latter can be completely received by that portion of the recesses which is closed towards the inside by the material portion 4. These material portions 4 form the seats for the armoring rings 7 which rest directly on these seats in the completed commutator by exerting a high pressure. Since the segments 1 are punched, the contour of these seats forms a polygon.

Figures 11, 12:
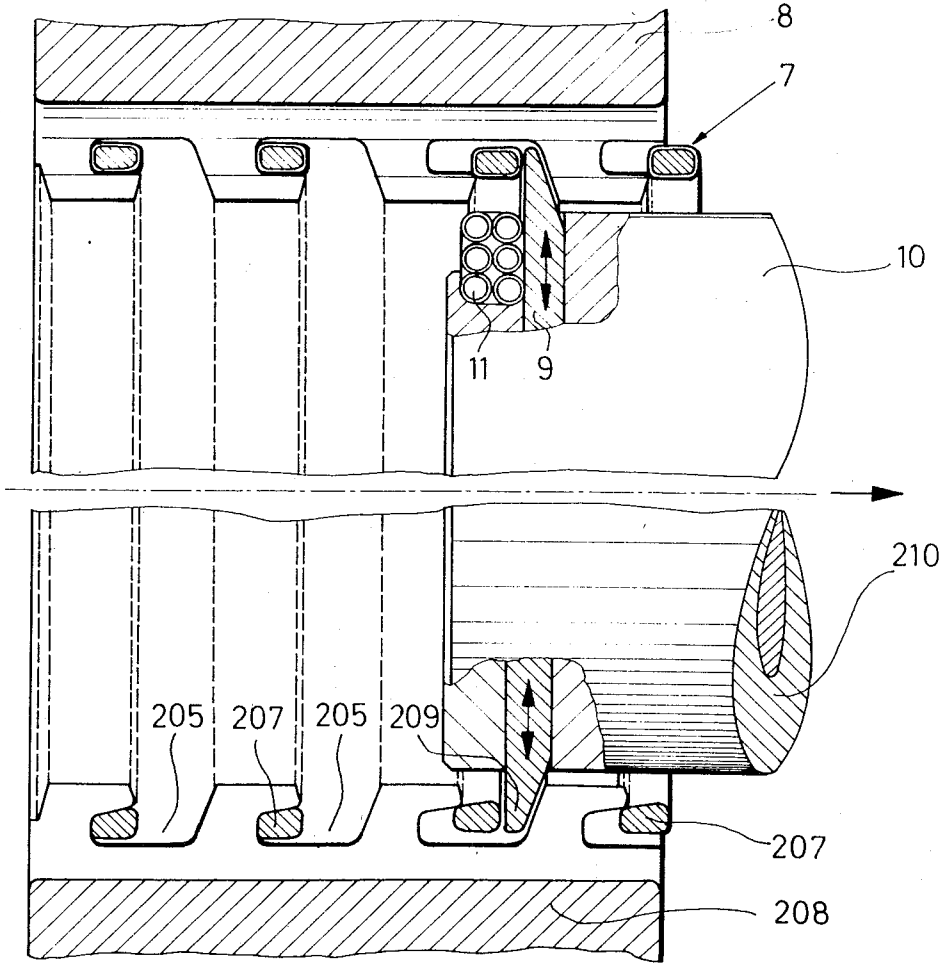
FIG. 11 is a schematic and partial longitudinal cross-section through a segment set and a device for the production of a armored segment set for the use of armoring rings of steel.
FIG. 12 is a longitudinal cross-section according to FIG. 11 for the production of a segment set armored with rings of fiber-reinforced plastic material.

After the armoring rings 7 have been inserted in the openings 5 of the still loosely assembled segment set, the segment set is pressed into a thick-walled pressure sleeve 8 as shown in FIG. 11, for example, with the help of a conical bushing. With this pressing of the segment set into the pressure sleeve 8, the diameter of the segment set is reduced to a pre-determined value which depends on the size of the arch-thrust which is to be produced in the segment set with the reduction in diameter. If the armoring rings 7 shall be made to only slide and not shrink on their seats formed by the material portions 4 after the desired diameter of the segment set has been reached, then the inner diameter of the armoring rings 7 is selected in such a way that only a slight pressure is necessary in order to slide them on their seats. The insulation 7'' is then not cut or damaged in any way. The sliding of the reinforced rings 7 into the recesses 3 is effected with the help of at least three sliding elements 9 which are equally distributed over the circumference and are arranged in a slide die 10 which can move in a radial direction and can be introduced into the borehole of the segment set. Since the widths of the openings 5 measured in the axial direction is larger than the width of the armoring rings 7, the slide elements 9 can be made to rest against one front end of the armoring rings 7 as is shown in FIG. 11. The armoring rings 7, including the one which is to be introduced into the annular slot formed by the recesses 2, are successively made to slide on their seats by means of the slide elements 9.

However, the armoring rings 7 may also be shrunk on their seats. In this case, the slide die 10 as well as the slide elements 9 consists of an insulating material. Additionally the slide die 10 has a ring inductor 11 directly axially next to the slide elements 9 and thus at the level of the armoring rings 7 which is connected to a medium frequency generator. The inner diameter of the armoring rings 7 is selected in this case in such a way that the armoring rings can be made to slide on their seats without much of a play after they have been heated to a pre-determined temperature by means of the ring inductor 11. With the subsequent cooling, the armoring rings are subjected to a considerable tension.

So as to avoid having the pressure sleeve 8 also inductively heated by the ring inductor 11, it consists of an anti-magnetic material such as stainless steel when the armoring rings 7 are shrunk on their seats. Additionally, it is provided with a water- cooling system which is controlled by a heat sensor which keeps the pressure sleeve 8 at a constant temperature in order to prevent a gradual expansion by means of the heat flowing from the segment set towards the outside.

After the armoring rings 7 are slid or shrunk on their seats, the segment set is ejected from the pressure sleeve 8. If the armoring rings 7 have only been slid on, the segment set expands with the reduction of its arch-thrust until an equilibrium is reached between the tension of the armoring rings and the expansion force of the segment set. In the case of shrunk-on armoring rings, it depends on the initial tension which the armoring rings have after having been shrunk on whether the segment set is subjected to an expansion after having been ejected from the pressure sleeve 8. Therefore, the arch-thrust in the segment set can be kept at a considerably higher value in this instance than in the first mentioned case.

Now, the segment set can be placed concentrically on a hub in order to complete the commutator, and insulating molding material can then be inserted under pressure, filling the interspace between the arched set and the hub as well as the recesses 2 and 3, the openings 5 and the interspaces between the segments 1. A molded plastic commutator is thus obtained with a relatively high arch-thrust and, concomitantly, high dynamic loading capability.

Another possibility consists of expanding the segment set by heating and inserting an insulating molding material 12 under pressure between the heated segment set and a hub 13 arranged concentrically in the latter until the set rests against a bushing (not shown) which receives the segment set in this instance as it is described in the German Disclosure Publication 30 48 470. The inner diameter of this bushing and thus the dimension of the expansion of the armored segment set are chosen in this case in such a way that, after the cooling of the molded material the hub 13 of the commutator is radially prestressed by an essential and pre-determined portion of the tension forces of the armoring rings 7. As is shown in FIG. 5, the recesses 2 and 3, the openings 5 as well as the interspaces between the segments 1 are completely filled with molded material. However, the armoring rings 7 rest directly on their seats. Thus, it is not the task of the molded material to form an insulation between the armoring rings and the segments. The material portions 4 which form the seats for the armoring rings 7 are increasingly subjected to stress by the fact that the armoring rings are expanded together with the segment set under the pressure of the inserted molding material but, simultaneously, the load is essentially removed from them by the orthotropic arch developed by the set and the molding material pressed into the interspaces.

In case the segment set is expanded in the manner described above, it is of advantage that the force-path ratio of the armoring rings is very high in comparison with that of the segment set and the surface of the segments which is subjected to the arch-thrust can be kept low in comparison with the overall cross-sectional surface of the armoring rings because the armoring rings are arranged at short distances over the length of the segments. The arch-thrust which develops after the segment set is ejected from the pressure sleeve 8 can, therefore, be kept so high that arch thrust is still sufficient even after the subsequent expansion. At the same time, the commutator according to the invention increases, in an ideal manner, the effectiveness regarding the reduction of a thermal deformation by the fact that the hub is radially prestressed by a considerable tension portion of the armoring or shrunk rings arranged at short distances in the segment set. Thus, the commutator according to the invention is distinguished by a particularly high dynamic and thermal load capacity.

Figure 7:
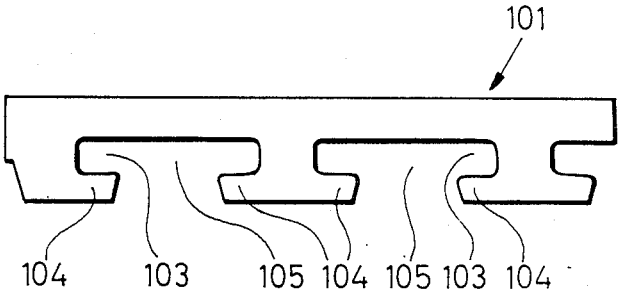
FIG. 7 is a side view of a modified embodiment of a segment for a commutator according to the invention.
Figure 8:
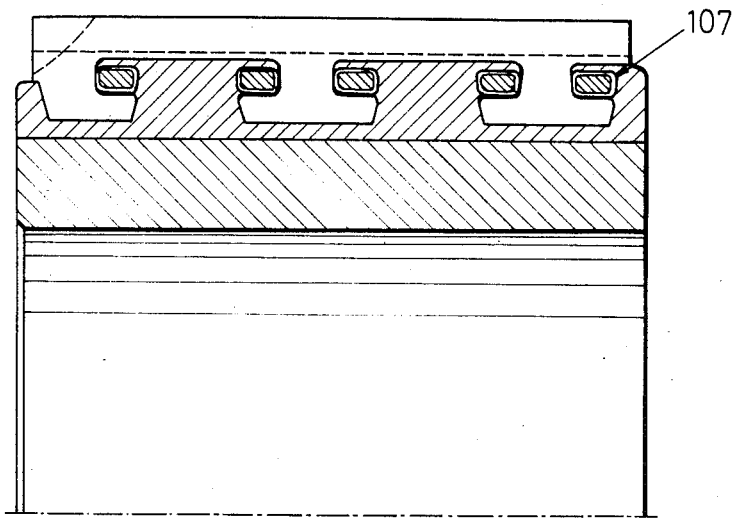
FIG. 8 is a partial longitudinal cross-section of a commutator with segments according to FIG. 7.

The second exemplified embodiment shown in FIGS. 7 and 8 differs from the above described exemplified embodiment only by the fact that the opening 105 is centrally arranged with the recesses 103 of the segments 101 which are open towards the central longitudinal axis of the commutator. Thus, the segments 101 have two material portions 104 for each recess 103 which makes it possible to insert two armoring rings 107 into each recess 103. Concerning the other details reference is made to the explanations in connection with the exemplified embodiment according to FIGS. 1 to 6 which apply also to this second exemplified embodiment.

Figure 10:
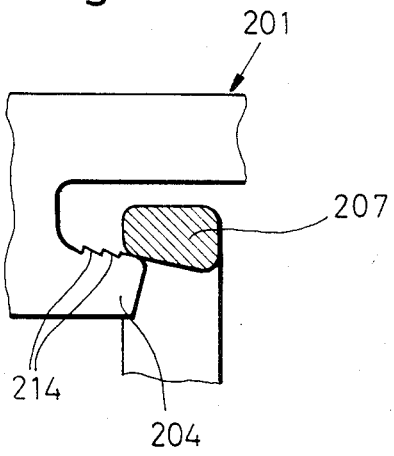
FIG. 10 is a section from a side view of a modified design of a segment and a partial cross-section of the pertinent armoring ring of fiber-reinforced plastic material before being pressed on its seats.
Figure 9:
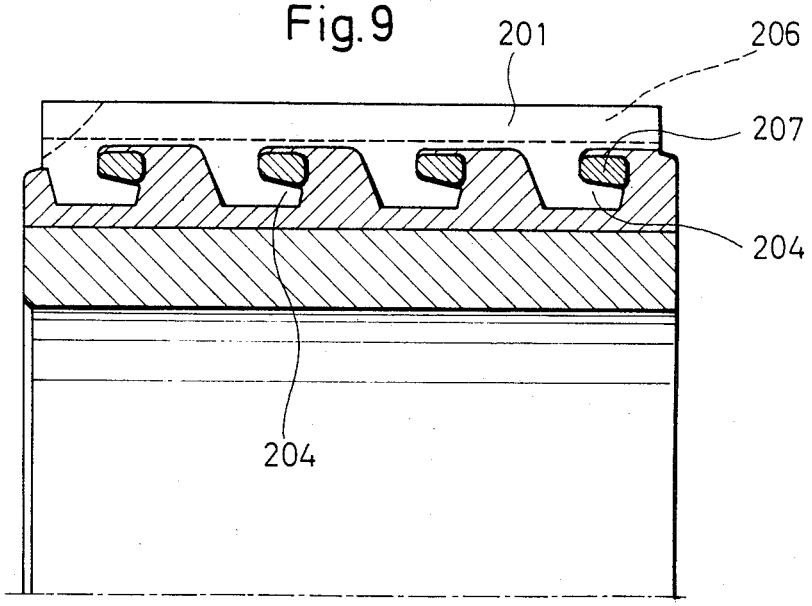
FIG. 9 is a partial longitudinal cross-section of a commutator with armoring rings of fiber-reinforced plastic material.

In the case of the exemplified embodiments shown in FIGS. 9, 10 and 12, the armoring rings 207 consists of a fiber-reinforced, electrically insulating plastic material. The strength values of this material correspond with those of a high-quality steel. In order to achieve a sufficient initial tension, a higher tension path is, however, necessary owing to the higher expansion of this material.

The segments 201 of the commutator are designed as the segments 1 of the first exemplified embodiment, with one exception. This exception consists of the fact that the material portions 204 do not form a seat with a constant diameter but a seat each whose diameter is decreased towards the free end of the material portion 204, i.e. towards the opening 205. The inner cover surface of the armoring rings 207 forms a corresponding angle. The angle of inclination of this surface and of the pertinent seat is chosen in this instance in comparison with the central longitudinal axis of the commutator in such a way that self-locking is guaranteed between the armoring rings and their seats.

After having assembled the segment set consisting of the segments 201 and the strip-shaped insulating plates 206 and after having placed the armoring rings 207 into the openings 205, the segment set is pressed into a pressure sleeve 208. The diameter is reduced to the desired value and the desired arch-thrust is obtained. As is shown in FIG. 12, the inner diameter of the armoring rings 207 is chosen in such a way that the armoring rings can be made to slide on their pertinent seats by being expanded. This sliding-on which is performed with a relatively high force is effected with the help of a steel pressure die 210 which can be introduced into the borehole of the segment set. At least three steel slide elements, which are distributed uniformly over the circumference of the die, can be operated in the radial direction from the pressure die 210 in the same manner as the slide elements 9. The shape of the slide elements 209 is the same as that of the slide elements 9. Also, the width of the openings 205 is the same as that of the openings 5.

After all armoring rings 207 are pressed on their seats, the segment set is ejected from the pressure sleeve 208 which is steel and need not be anti-magnetic. Whether and, possibly, to what extent the segment set is now expanded depends on the prestress which the armoring rings 207 received when being pressed on their seats.

The further processing of the armored segment set is effected, by using a process described in connection with the exemplified embodiment according to FIGS. 1 to 6.

In order to further secure the armoring rings 207 consisting of fiber-reinforced plastics against sliding from their seats or in order to provide an angle which is not self-locking, the seats formed by the material portions 204 for the armoring rings may be provided with elements, as is shown in FIG. 10, which counteract a sliding of the armoring rings. As FIG. 10 shows, these elements could be, for example, barbs 214 which are produced with the punching of the recess. These barbs 214 penetrate into the armoring ring 207 and fully prevent a shifting towards the end of the seat, which has a smaller diameter.

The commutator can also be produced by shrinking the armored segment set directly on an insulated hub or shaft, i.e. without being filled with molded plastic, or by connecting it with the hub in accordance with a process indicated in the German Disclosure Publication 30 48 470 (Page 17, FIG. 7).

In the latter case, the conical shape of the inner cover surface of the segments can be obtained in a simple manner by means of a conical shape of the future inner edge of the segments 1; 101; 201 by punching in the course of the production of the recesses 2; 3; 103.

In these two cases, the segments of the commutator are "air-insulated" in their area towards the commutator axis underneath the insulating plates keeping them at a distance from each other.

All features mentioned in the above given description as well as those which can only be taken from the drawing form, as further designs, part of the invention, even if they are not especially emphasized and particularly not mentioned in the claims.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A process for the production of a commutator of the arch-thrust type having a segment set, comprising the steps of temporarily reducing the diameter of the segment set, at least to the extent that, subsequently, an armoring ring can be made to slide into an interior annular slot which is formed by the punching of the segments, said punching forming a polygonal seat on said interior annular slot and a portion of said interior annular slot open to the central axis of the segment set; and inserting the armoring ring so as to rest on the polygonal seat on the interior annular slot existing in the segment set which ring receives a radial tension.

2. The process according to claim 1, wherein the segment set is temporarily reduced in its diameter, after the armoring ring is placed into the portion of the annular slot open towards the central longitudinal axis, at least to such an extent that, subsequently, the armoring ring can be made to slide into the part of the annular slot which is closed towards the central longitudinal axis and forms a seat for the armoring ring.

3. The process according to claim 2, wherein the segment set is pressed into a thick-walled pressure sleeve in order to reduce its diameter and is taken out of the sleeve again after all existing armoring rings have been made to slide on the seats of the segment set assigned to them.

4. The process according to claim 1, wherein each armoring ring is heated in an inductive manner to such an extent that the enlargement of its inner diameter which is effected in this way permits its sliding on the seat assigned to it and formed by the segment set and that the armoring ring is shrunk on its seat by cooling before the force is terminated by which the reduction in diameter of the segment set has been effected.

5. The process according to claim 4, wherein the pressure sleeve which consists of an anti-magnetic material and receives the segment set during the heating of the armoring ring or rings is kept at a constant temperature.

6. The process according to claim 1, wherein each armoring ring is pressed on its seat in axial direction.

7. A process for the production of a commutator of the arch-thrust type having a segment set, comprising the steps of:

punching interior openings in the segments, each of said interior openings forming a polygonal seat and a portion open to the central axis of the segment;

loosely assembling the set of a commutator segments having interior openings including inserting an insulated steel armoring ring into the interior openings in the segments through the portion of the segment open to the central axis;

expanding the armoring ring;

sliding the expanded armoring ring onto the polygonal seat within the segment set; and shrinking the armoring ring so as to subject the ring to tension as the ring contracts the segments together.

8. The process according to claim 7, wherein the diameter of the segment set is temporarily reduced prior to expanding the armoring ring.

9. The process according to claim 8, wherein the diameter of the segment set is reduced by inserting the segment set into a pressure sleeve.

10. The process according to claim 9, wherein the commutator set is removed from the pressure sleeve after the armoring ring has shrunk.

11. The process according to claim 7, wherein the armoring ring is slid onto its seat in an axial manner.

12. The process according to claim 7, wherein the armoring ring is expanded by heating.

13. The process according to claim 12, wherein the armoring ring is heated by inductive heating.

14. A process for the production of a commutator of the arch-thrust type having a segment set, comprising the steps of:

punching interior openings in the segments, each of said interior openings forming a polygonal seat and a portion open to the central axis of the segment;

loosely assembling the set of a commutator segments having interior openings therein that form a tapered, polygonal annular groove within the commutator set, said groove having an angled seat therein including inserting into the annular groove of the commutator set through the portion of the segment open to the central axis, an insulating armoring ring having an inner surface that inclines at an angle corresponding to the angled seat of the opening;

pressing the segment set into a pressure sleeve to compress the segments together and reduce the diameter of the segment set;

pressing said ring tightly onto the angled seats within the groove; and removing the commutator set from the pressure sleeve.

15. The process according to claim 14, wherein the rings are pressed onto their seats in an axial direction.

* * * * *

UNITED STATES PATENT AND TRADEMARK OFFICE

CERTIFICATE OF CORRECTION

PATENT NO. : 4,598,463

DATED : July 8, 1986

INVENTOR(S) : KARL-HEINZ GERLACH

It is certified that error appears in the above-identified patent and that said Letters Patent is hereby corrected as shown below:

On page 1 (cover), item 30, the Foreign Application Priority Data is incorrect. Instead of Dec. 10, 1983, please enter Dec. 10, 1982.

Column 10, line 18, after "of" delete --a--.

Signed and Sealed this

Twenty-eighth Day of October, 1986

[SEAL]

*Attest:*

DONALD J. QUIGG

*Attesting Officer*

*Commissioner of Patents and Trademarks*